US007201299B2

(12) United States Patent
Forsman

(10) Patent No.: US 7,201,299 B2
(45) Date of Patent: Apr. 10, 2007

(54) WAIST-MOUNTED HYDRATION SYSTEM

(75) Inventor: Barley A. Forsman, Cotati, CA (US)

(73) Assignee: CamelBak Products, LLC, Petaluma, CA (US)

( * ) Notice: Subject to any disclaimer, the term of this patent is extended or adjusted under 35 U.S.C. 154(b) by 0 days.

(21) Appl. No.: 10/917,207

(22) Filed: Aug. 11, 2004

(65) Prior Publication Data

US 2005/0035160 A1 Feb. 17, 2005

Related U.S. Application Data

(60) Provisional application No. 60/495,199, filed on Aug. 13, 2003.

(51) Int. Cl.
*A45F 3/00* (2006.01)

(52) U.S. Cl. ..... 224/148.2; 224/148.6; 224/662

(58) Field of Classification Search ..... 224/148.1, 224/148.2, 148.5, 148.6, 148.3, 148.4, 666, 224/669, 660, 662, 663, 680; 602/19
See application file for complete search history.

(56) References Cited

U.S. PATENT DOCUMENTS

| | | | | |
|---|---|---|---|---|
| 828,891 | A | 8/1906 | Krueger | |
| 4,029,243 | A * | 6/1977 | Zerobnick et al. | 224/681 |
| 4,090,650 | A | 5/1978 | Gotta | |
| 4,135,503 | A * | 1/1979 | Romano | 602/13 |
| 4,139,130 | A | 2/1979 | Glusker et al. | |
| 4,176,772 | A | 12/1979 | Danon | |
| 4,265,381 | A | 5/1981 | Muscatell | |
| 4,449,654 | A | 5/1984 | Cappis | |
| 4,544,087 | A | 10/1985 | Modig | |
| 4,627,554 | A | 12/1986 | Leibinsohn | |
| 4,747,527 | A * | 5/1988 | Trumpower, II | 224/662 |
| 4,852,781 | A | 8/1989 | Shurnick et al. | |
| 4,911,345 | A * | 3/1990 | James et al. | 224/149 |
| 4,948,023 | A | 8/1990 | Tripp | |
| 5,060,833 | A | 10/1991 | Edison et al. | |
| 5,085,349 | A | 2/1992 | Fawcett | |
| 5,104,016 | A | 4/1992 | Runkel | |

(Continued)

OTHER PUBLICATIONS

The Integrator advertisement, FasTrak Systems, Inc., 1996.

(Continued)

*Primary Examiner*—Nathan J. Newhouse
*Assistant Examiner*—Justin M. Larson
(74) *Attorney, Agent, or Firm*—Kolisch Hartwell, P.C.

(57) ABSTRACT

Waist-mounted hydration systems that include a fluid reservoir, an elongate drink tube that extends from the reservoir and terminates at a mouthpiece from which a user can draw drink fluid from the reservoir, and a pack that houses the reservoir. The pack is secured around a user's waist by a waist strap assembly. In some embodiments, the waist strap assembly provides a continuous strap that extends around the user's hips and abdomen, and which may be free from rigid body-contacting components. In some embodiments, the hydration system includes a reservoir compression assembly. In some embodiments, the hydration system includes a waist strap assembly that, upon tightening of the strap assembly, is configured to initially apply compression to the reservoir and subsequently to shorten the length of the strap assembly around a user's waist. In some embodiments, the free ends of the waist strap(s) extend from behind a user.

26 Claims, 7 Drawing Sheets

U.S. PATENT DOCUMENTS

| | | | | |
|---|---|---|---|---|
| 5,228,609 | A | 7/1993 | Gregory | |
| 5,301,858 | A | 4/1994 | Hollander | |
| 5,427,290 | A | 6/1995 | Thatcher | |
| 5,431,308 | A | 7/1995 | Tchen | |
| 5,566,869 | A | 10/1996 | Katz | |
| 5,570,824 | A * | 11/1996 | Lyon et al. | 224/240 |
| 5,571,260 | A | 11/1996 | Krug | |
| 5,577,653 | A * | 11/1996 | Bieker | 224/684 |
| 5,645,404 | A * | 7/1997 | Zelenak | 417/1 |
| 5,727,714 | A | 3/1998 | Fawcett | |
| 5,727,720 | A | 3/1998 | Thatcher | |
| D398,776 | S | 9/1998 | Fawcett | |
| 5,803,333 | A | 9/1998 | Fawcett | |
| D411,915 | S | 7/1999 | George | |
| 5,938,089 | A | 8/1999 | Abreu-Marston | |
| 5,984,145 | A * | 11/1999 | McAllister | 222/175 |
| 6,032,831 | A | 3/2000 | Gardner et al. | |
| 6,070,767 | A | 6/2000 | Gardner et al. | |
| 6,247,619 | B1 * | 6/2001 | Gill et al. | 222/105 |
| 6,364,168 | B1 | 4/2002 | Gardner et al. | |
| 6,409,048 | B1 | 6/2002 | Belzeski | |
| 6,497,348 | B2 | 12/2002 | Forsman et al. | |
| 6,585,673 | B1 * | 7/2003 | Bass | 602/60 |
| 6,598,770 | B2 | 7/2003 | Bolts | |
| 6,666,360 | B1 * | 12/2003 | Swank | 224/148.2 |
| 6,675,998 | B2 | 1/2004 | Forsman et al. | |
| 2003/0121945 | A1 * | 7/2003 | Lemanski, II | 224/579 |
| 2004/0065703 | A1 * | 4/2004 | Bellucci | 224/148.5 |
| 2006/0000856 | A1 * | 1/2006 | West | 224/148.2 |

OTHER PUBLICATIONS

The CamelBak Narrow Guage System advertisement, FasTrak Systems, Inc., 1996.
The Pakster advertisement, FasTrak Systems, Inc., 1996.
The HydroBak advertisement, FasTrak Systems, Inc., 1996.
The$H_2$•Flow advertisement, FasTrak Systems, Inc., 1996.
The MULE advertisement, FasTrak Systems, Inc., 1996.
CamelBak Profit System Catalog, Aug. 1996.
CAMELBAK® Hydrate or Die® advertisement, FasTrak Systems, Inc., 1996.

* cited by examiner

Fig. 4
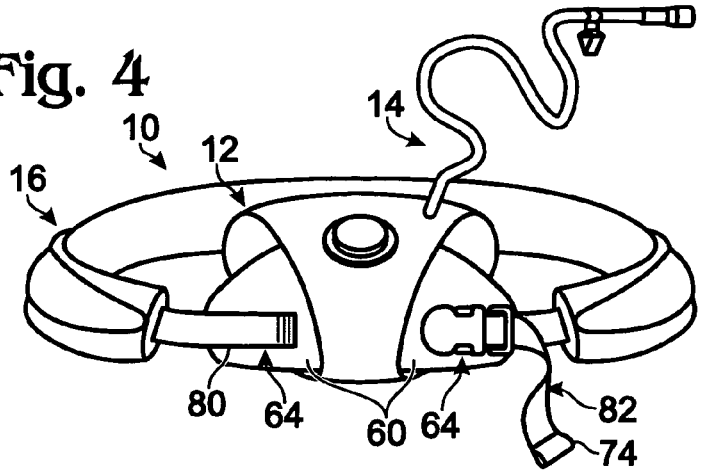
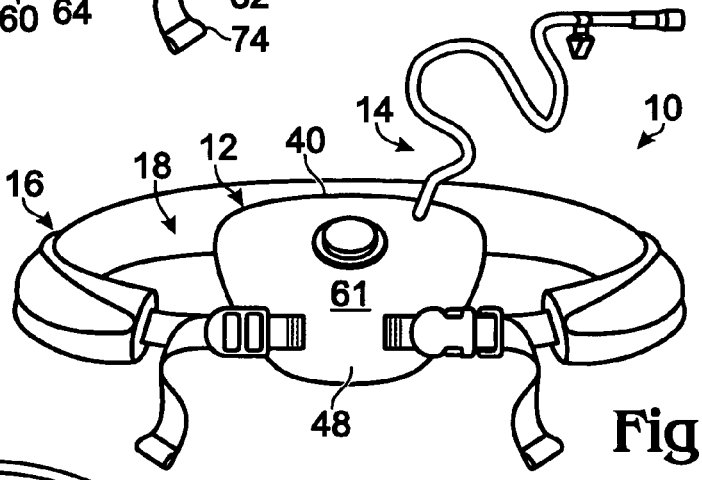
Fig. 5
Fig. 6
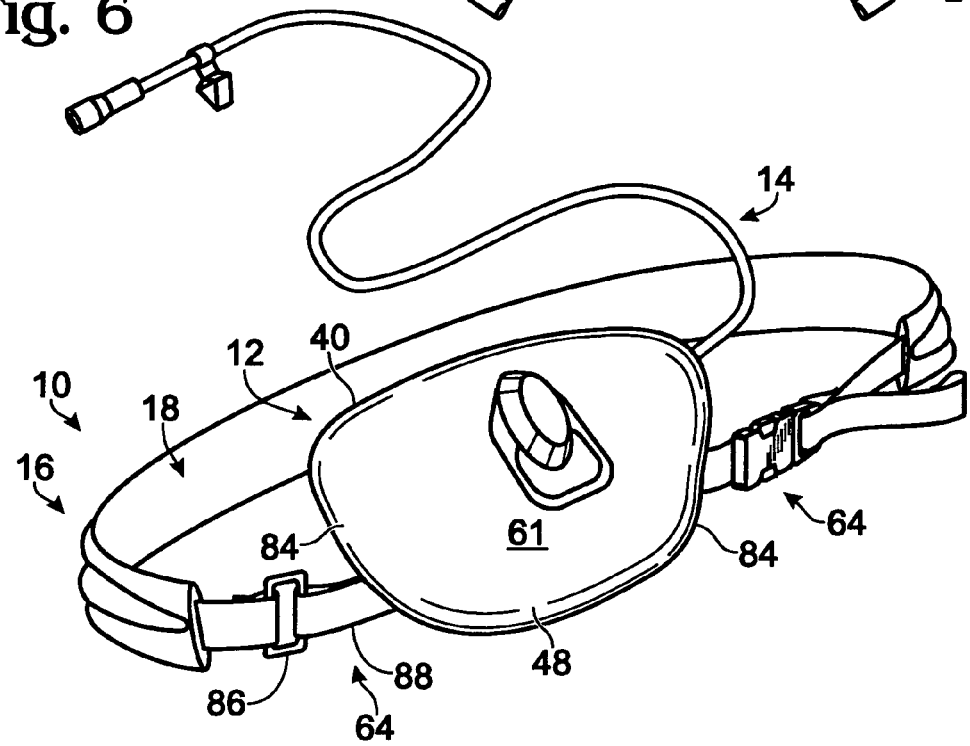

Fig. 14
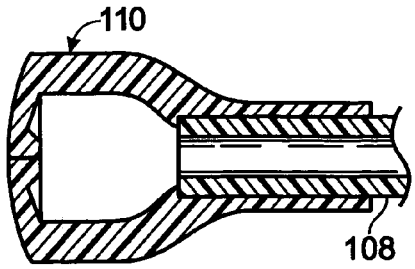
Fig. 15
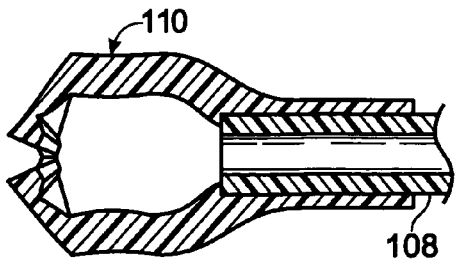
Fig. 16
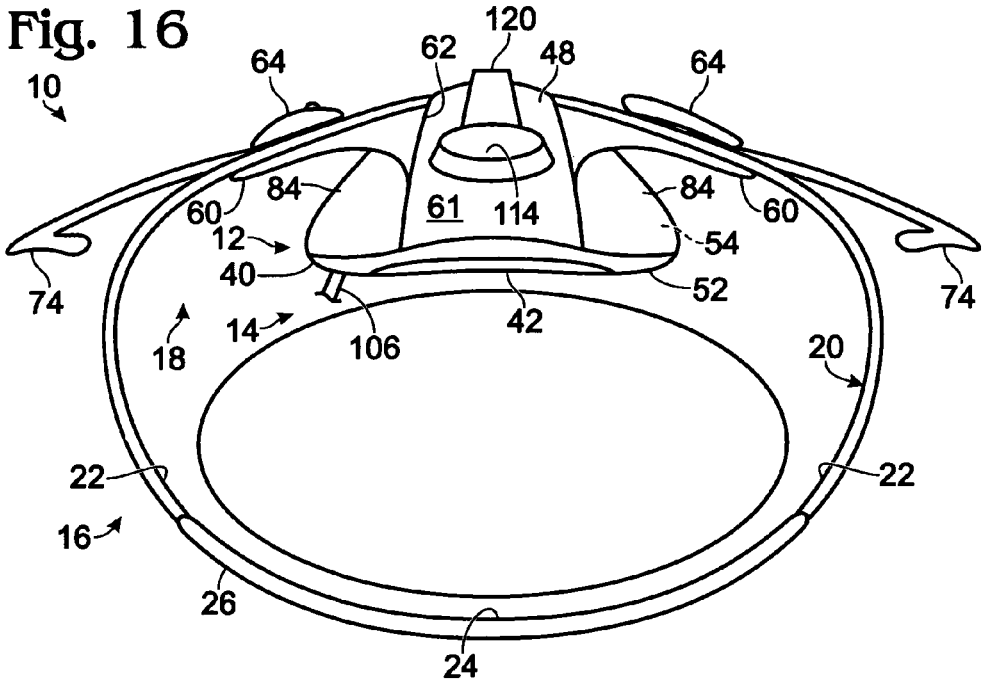
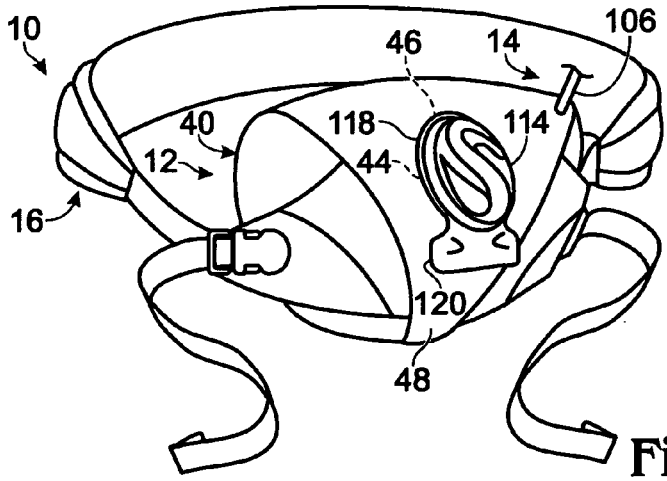
Fig. 17

WAIST-MOUNTED HYDRATION SYSTEM

RELATED-APPLICATION

The present application claims priority to U.S. Provisional Patent Application Ser. No. 60/495,199, which was filed on Aug. 13, 2003, and the complete disclosure of which is hereby incorporated by reference for all purposes.

FIELD OF THE DISCLOSURE

The present disclosure is generally directed to personal hydration systems, and more particularly directed to waist-mounted hydration systems.

BACKGROUND OF THE DISCLOSURE

As used herein, the term "hydration system" refers to a fluid reservoir from which an elongate drink tube extends and terminates at a mouthpiece from which a user may draw drink fluid from the reservoir. The reservoir is often a flexible fluid reservoir that includes a resealable fill port through which drink fluid may be poured into the reservoir, and an exit port through which drink fluid may be drawn through the drink tube. The reservoir is typically housed in a body-mounted pack that enables the reservoir to be carried on a user's body. Conventional hydration systems include back-mounted backpack-style hydration systems, waist-mounted hydration systems, and hydration systems that include both waist and shoulder straps.

In the context of waist-mounted hydration systems, the pack is conventionally designed to be secured around a user's waist with the reservoir supported proximate a user's lower back. The pack includes a pair of straps that extend from opposed sides of the pack and are designed to respectively extend around a user's hips and to be coupled together with a buckle or other fastener proximate the user's abdomen. Conventionally, rigid clips or similar fasteners are used. Typically, at least one of the straps is adapted have an adjustable length, with the free end of the strap dangling from the fastener in front of the user when the hydration system is worn. Some hydration systems include a mechanism for applying compression to the reservoir, as this compression makes it easier to draw drink fluid from the reservoir. Conventionally, waist-mounted hydration systems either do not include any compression system or they include a compression system that uses a strap assembly that is operated independent of the waist strap. By "independent of," it is meant that the compression to the reservoir can be increased using the compression system without adjusting the waist straps, and vice versa.

SUMMARY OF THE DISCLOSURE

The present disclosure is directed to waist-mounted hydration systems that include a fluid reservoir for drink fluid, an elongate drink tube that extends from the reservoir and terminates at a mouthpiece from which a user can selectively draw drink fluid from the reservoir, and a pack that houses the reservoir and which is adapted to be secured around a user's waist by a waist strap assembly. In some embodiments, the waist strap assembly provides a continuous strap that extends around the user's hips and abdomen. In some embodiments, the waist strap assembly is selectively fastened at least proximate the pack to form a closed loop around the user's waist. In some embodiments, the hydration system provides a collective contact surface that faces the user's body and which is free from rigid components. In some embodiments, the hydration system includes a reservoir compression assembly that is integrated with the waist strap assembly. In some embodiments, the hydration system includes a waist strap assembly that, upon tightening of the strap assembly, is configured to initially apply compression to the reservoir and subsequently to shorten the length of the strap assembly around a user's waist. In some embodiments, the free ends of any straps of the hydration system extend from behind a user when the hydration system is properly worn by a user.

BRIEF DESCRIPTION OF THE DRAWINGS

FIG. 4 is a rear perspective view of another waist-mounted hydration system according to the present disclosure.

FIG. 5 is a rear perspective view of another waist-mounted hydration system according to the present disclosure.

FIG. 6 is a fragmentary rear perspective view of another waist-mounted hydration system according to the present disclosure.

FIG. 14 is a cross-sectional view of an illustrative bite-actuated mouthpiece in a closed configuration.

FIG. 15 is a cross-sectional view of an illustrative bite-actuated mouthpiece in a dispensing configuration.

FIG. 16 is a top plan view of another waist-mounted hydration system according to the present disclosure schematically illustrated relative to a user's body.

FIG. 17 is a rear perspective view of another waist-mounted hydration system according to the present disclosure.

DETAILED DESCRIPTION AND BEST MODE OF THE DISCLOSURE

Figure 1:
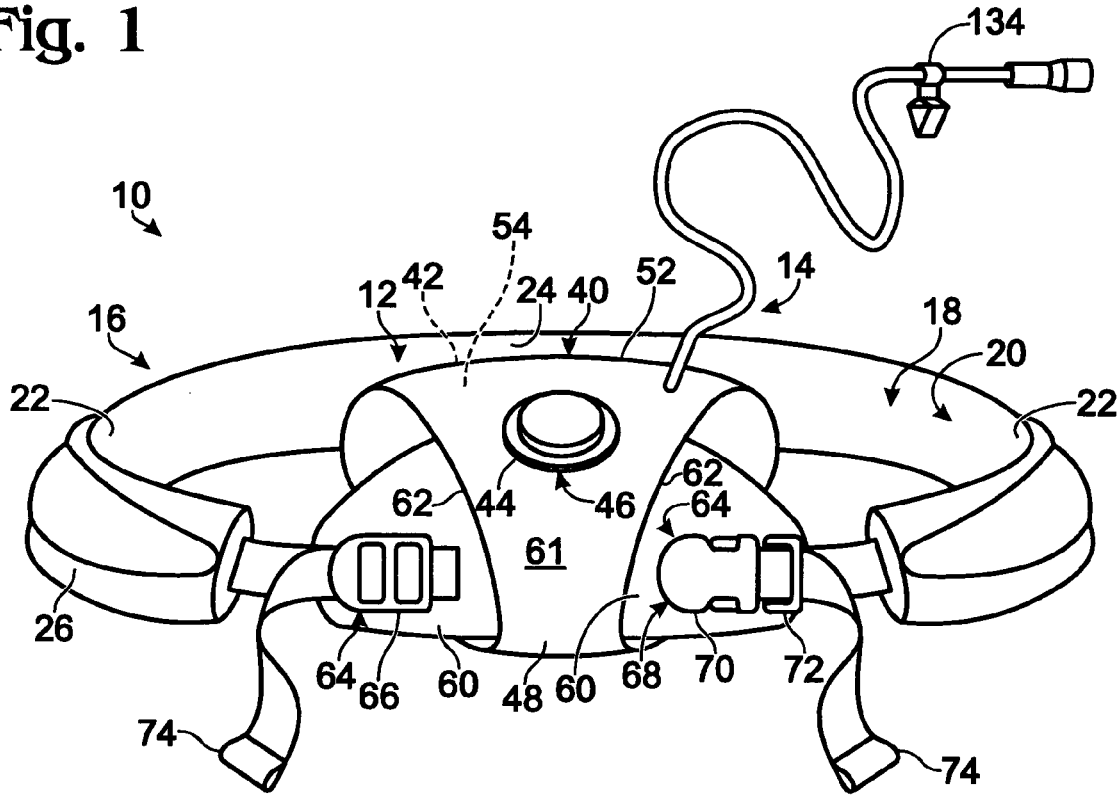
FIG. 1 is a rear elevation view of a waist-mounted hydration system according to the present disclosure.
Figure 2:
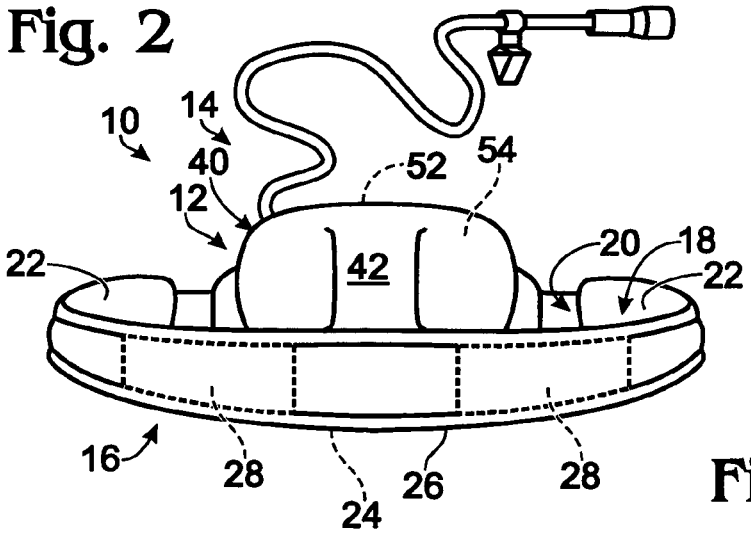
FIG. 2 is a front elevation view of the waist-mounted hydration system of FIG. 1.

A waist-mounted hydration system according to the present disclosure is shown in FIGS. 1 and 2 and generally indicated at 10. System 10 includes a pack 12, into which a hydration assembly 14 is partially received, and a waist strap 16 that is adapted to extend around a user's waist to secure the waist pack upon a user's body. When worn by a user, the pack is positioned proximate the user's lower back, with the waist strap extending around the user's hips and abdomen to define a closed loop around the user's waist. In the illustrated embodiment, the waist strap and pack collectively form a closed loop 18. By this it is meant that the waist strap and pack collectively define a closed boundary that is sized to extend around a user's waist. It is within the scope of the disclosure that the waist strap may cooperate with other elements of the hydration system to form this closed loop, or that the waist strap may itself form a closed boundary around the user's waist. In this latter embodiment, the pack may be slidably, fixedly or otherwise coupled to the strap.

As perhaps best seen in FIG. 1, the waist strap extends from and returns to the pack to define the above-described closed loop, with the inner surface of the strap defining a body-contacting surface 20. As used herein, the term "body-contacting" refers to external portions of the hydration system that face and are compressed against a user's body when the hydration system is properly worn around a user's waist. These portions may extend directly against the user's body or against the user's garments (shirt/shorts, etc.) that are positioned between the user's body and the body-contacting portions of the hydration system. Therefore, the term "body-contacting" does not require actual physical contact with the user's body so much as referring to the portions of the hydration system that are oriented to contact the user's body when the hydration system is properly worn around a user's waist. As such, surface 20 may also be referred to as a body-facing surface.

Waist strap 16 may be described as including a pair of hip-contacting regions 22 and an abdomen-contacting region 24 between the hip-contacting regions. Each of these regions includes a flexible contact surface that extends against a user's body or the user's clothing as the hydration system is worn around the user's waist. As direct contact with the user's skin is not required, the abdomen- and hip-contacting regions may be referred to as abdomen-facing and hip-facing regions that are respectively adapted to face a user's abdomen and hips when the hydration system is worn around a user's waist. In the illustrated embodiment, each of these contact surfaces is free from fasteners, buckles, clips or other rigid (such as metal or hard plastic) structures, with the contact surfaces extending in a continuous relationship relative to each other. Preferably, these surfaces are flexible, such as being soft and pliable. Accordingly, strap 16 may be described as providing a continuous contact surface that extends around the user's hips and abdomen and which is free from hard or rigid structures that are compressed against the user's body when the hydration system is worn. This continuous contact surface includes at least one continuous strap, and it is within the scope of the present disclosure that it may include two or more continuous straps that each are coupled to the pack to define a closed loop around the user's waist. In contrast to conventional waist straps that include two or more discontinuous straps that are releasably secured together by one or more rigid fasteners proximate a user's abdomen, strap 16 should not pinch, scrape or otherwise provide discomfort to a user when system 10 is worn and used while the user is engaged in athletic activities.

In FIGS. 1 and 2, waist strap 16 is shown including an optional padding layer, or band, 26 that extends along at least a portion of the length of the strap to cushion the contact between system 10 and the user's body. Padding layer 26 may take any suitable form, such as a layer of padding that is sewn or otherwise secured to strap 16, a sleeve of material that is slidably or fixedly secured to the strap, two or more discontinuous regions of padding material that extend in spaced-apart configurations along strap 16, etc. The padding layer alternatively may be integrated with the strap.

Figure 3:
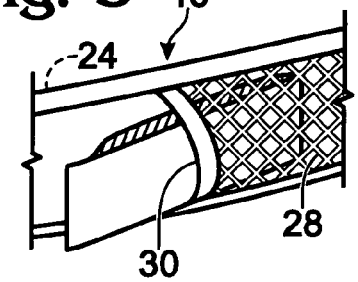
FIG. 3 is a fragmentary detail showing a variation of the waist strap shown in FIG. 2.

Strap 16 may optionally include one or more storage compartments 28, such as indicated in dashed lines in FIG. 2. Storage compartments 28 may be located on any suitable position on the strap, and may include compartments that are adapted to be accessed while the user is wearing the pack and engaged in athletic activities and/or compartments that are most likely only accessed while the user is not engaged in athletic activities. Examples of this latter type of compartment include smaller pockets with zippered openings for holding money, keys, and the like. Typically, compartments that are designed to be accessed while a user is engaged in athletic activities will include an opening that is easily accessed, such as openings that include hook-and-loop closures or elastic closures. For example, FIG. 3 illustrates an example of a compartment 28 with an elastic closure and which is designed to hold an energy bar or similar item that may be accessed by a user while engaged in athletic activities. At least a portion of the compartment, such as the outer surface thereof, may be formed from a stretchable, resilient material, such as an elastic mesh, spandex or the like.

As perhaps best seen in FIG. 2, pack 12 includes a pack body, or housing, 40 with a body-contacting, or user-contacting, surface 42 that is oriented to extend against or at least toward a user's lower back when system 10 is properly worn by a user. Surface 42 may also be referred to as a body-facing surface, for reasons discussed herein. Surface 42 may also be referred to as an interior surface, as it is generally opposed to the subsequently described exterior surface of the pack body, with the interior surface configured to face a user's body, and the exterior surface configured to face away from the user's body. Surface 42 is preferably formed from a flexible material, and may optionally include or be at least partially formed from a padding material to cushion the engagement of the pack against the user's lower back. Pack 12 may be specifically sized to receive a fully charged fluid reservoir, as discussed in more detail herein. In some applications, it may be desirable for the pack to be as small as possible, and accordingly, the pack may not be designed to hold objects other than a fully charged fluid reservoir. It is within the scope of the disclosure, however, that the pack may be designed to hold objects in addition to the reservoir, such as in one or more storage pockets or other compartments. Illustrative examples of other objects that it may be desirable to carry in pack 12 include identification, money, keys, energy bars, mobile phones, first aid supplies, maps, etc.

In the illustrated embodiment and as perhaps best seen in FIG. 1, the pack includes a fill port opening 44 through which the fill port 46 of the subsequently described reservoir of the hydration assembly extends. As shown, fill port opening 44 extends from a rear surface 48 of the pack and faces generally away from body-contacting surface 42. Although this orientation is not required, it may be desirable because it orients the fill port and any cap or other closure mechanism away from the user's body in a position where the cap or other closure mechanism will not be unintentionally contacted by the user's body when system 10 is properly worn and while the user is engaged in athletic activities. It is within the scope of the present disclosure that the pack may receive the entire reservoir and associated fill port within the pack's compartment, with the pack not including a fill port opening. It is also within the scope of the present disclosure that packs that include a fill port opening 44 may also include a cover that selectively extends over the fill port, such as to provide a dust cover.

As indicated at 52 in FIGS. 1 and 2, pack 12 may also include a reservoir opening through which the reservoir may be selectively removed from and reinserted into a compartment 54 within the pack. When pack 12 includes such an opening, the opening preferably includes a suitable closure mechanism, such as a zipper, hook-and-loop mechanism, snap(s), etc. It is also within the scope of the present disclosure that the reservoir is fixedly secured within the pack's compartment. By this it is meant that the pack does not include a reservoir opening that is sized to permit repeated removal and reinsertion of the reservoir from the pack's compartment. In such an embodiment, the user may selectively fill, drain and clean the permanently mounted reservoir through fill port 46, which extends from the pack through fill port opening 44. To graphically depict that pack 12 may be formed with or without a reservoir opening, reference numeral 52 is indicated with a dashed line in FIG. 2.

As perhaps best seen in FIG. 1, pack 12 further includes a pair of flaps, or wings, 60 to which generally opposed regions of strap 16 are coupled. Flaps 60 extend from the rear surface 48 of the pack, and preferably extend from a central portion, or central region, 61 of the rear surface of the pack. As used herein, the central portion of the rear surface of the pack refers to the portion of the rear surface of the pack that overlies the central ¾ of the reservoir within the pack. A benefit of the illustrated configuration is that user-applied forces that would tend to reduce the size (i.e., the perimeter) of the closed loop formed by the strap (i.e., tighten the strap around the user's waist), are applied to the pack and draw the rear surface of the pack toward the user's body, thereby compressing the reservoir and thereby creasing a positive pressure, or force, that reduces the amount of force a user needs to apply to the mouthpiece of the hydration assembly to draw drink fluid from the reservoir. The flaps may be described as having first end regions that extend from the central portion of the pack, and second end regions that are distal the first end regions and to which the strap assembly is connected. In the illustrated example, the flaps at least partially overlap with (i.e., extend against) the exterior surface of the pack body.

Unlike some conventional waist-mounted hydration systems that include a compression system that operates independent of the pair of strap segments that are used to secure the hydration system around a user's waist, the illustrated waist-mounted hydration system enables the user to selectively apply compression to the pack (and its contents) and tighten the system around the user's waist through the use of a single strap 16. In a configuration such as when the strap is secured to a central portion of the rear surface of the pack, the compression is applied first to the pack and thereafter to the user's waist. Described in other terms, as at least one of the free end regions of the strap is drawn away from the pack, the length of the strap that forms a closed loop around the user's waist is shortened. If the rear surface of the pack is not compressed against the user's body, such as if the reservoir has been at least partially depleted of drink fluid or if the hydration system is being initially tightened around the user's waist, this rear surface of the pack will be drawn toward the user's body (and the body-contacting surface of the pack), with this movement of the rear surface of the pack tending to initially counteract the shortening of the length of the strap used to form the closed loop. As the pack is compressed, however, the rear surface resists being drawn further toward the user's body and the collective size of the closed loop will be decreased as the free end region of the strap continues to be drawn away from the pack.

In the illustrated embodiment, the wings each form an elongate region of contact, or attachment region, 62 with the body 40 of the pack. Described in other words, the portion of the wing that is coupled to the body of the pack is at least twice, and preferably at least three or more times the height of the strap. Preferably, this portion of the wing is at least ⅔, and preferably at least ¾, the height of the pack's body. Although this configuration is not required for all hydration systems 10 according to the present disclosure, potential benefits of having this elongate contact region are that the compressive forces applied via a user pulling on the strap are distributed along the pack, as opposed to being centralized to one or more discrete points on the pack, and/or that the pack is supported against folding or other unintentional bending or flopping along the vertical length of the user's back.

As shown, each flap includes a fastening mechanism 64 that couples a region of the strap 16 to the pack. In the illustrated example, the fastening mechanisms are positioned to contact the exterior surface of the pack. In such a configuration, when the hydration system is worn and strap 16 is tightened around a user's body, the fastening mechanisms are drawn against the exterior surface of the pack, and not against the user's body. As discussed, this enables the use of releasable and/or adjustable buckles, clips, and similar mechanisms while still providing a body-contacting surface that is free from hard or rigid objects.

In the illustrated example, these fastening mechanisms include an adjustable fastening mechanism 66 that is configured to adjustably secure the strap to the pack and a releasable fastening mechanism 68, which includes members 70 and 72 that are adapted to be selectively and repeatedly coupled together. Mechanism 66 may be referred to as a ladder lock, in that the strap is retained in a selected position relative thereto by threading the strap through the member. As shown, strap 16 is adjustably coupled to member 72, with each end of the strap including free end regions 74 that do not form part of the closed loop and which may be permitted to dangle or otherwise hang from the pack. As illustrated, the free end regions will hang from behind a user and therefore are less likely to contact the user's body or interfere with the user's activities than conventional straps that include free end regions that hang from in front of the user. System 10 may optionally include a strap management assembly that is adapted to secure the loose end regions. Illustrative examples of suitable strap management assemblies are disclosed in U.S. patent application Ser. No. 10/185,428, the complete disclosure of which is hereby incorporated by reference for all purposes.

A benefit of having a pair of adjustable fastening mechanisms is that the user can selectively apply compression to the reservoir and/or tighten the strap around the user's waist from either lateral side of the pack. More specifically, the user can selectively grasp and pull upon the free end region of the strap that extends from either fastening mechanism to apply compression (to the pack and then the portions of the strap forming the closed loop). This selective adjustment from either lateral side of the pack also permits the user to adjust the position of the pack relative to the user's body without rotating the entire hydration system about the user's waist. It is within the scope of the disclosure, however, that the strap may include one (end) region 80 that is fixedly and nonadjustably coupled to the wing or other portion of the pack, with the strap (and pack compression) being adjusted from the other end region 82 of the strap. An illustrative example of such a hydration system 10 is shown in FIG. 4. It is also within the scope of the present disclosure that the strap may be coupled (adjustably, nonadjustably, releasably and/or fixedly) to the central portion 61 of the rear surface of the pack without the inclusion of the above-described compression wings. An illustrative example of such a hydration system 10 is shown in FIG. 5.

Although the illustrated hydration systems shown in FIGS. 1 and 5 are depicted as including adjustable fastening mechanisms, namely, a ladder lock and releasable buckle, it is within the scope of the disclosure that any suitable releasable, fixed, adjustable and/or non-adjustable fastening mechanisms may be used. As used herein, a fixed fastening mechanism refers to a fastening mechanism that is not designed to be released without destroying at least a portion of the hydration system or the fastening mechanism. Examples of fixed fastening mechanisms include sewing, laminating, welding or bonding the strap to the pack, forming a closed loop of the strap around the fastening mechanism, and forming the strap as a unitary length of material with at least a portion of the pack.

It is within the scope of the present disclosure that strap 16 may be adjustably or non-adjustably coupled to portions of the pack other than the central portion of the rear surface of the pack. For example, the strap may be coupled to the perimeter region of the pack or to the body-contacting surface of the pack. It is also within the scope of the disclosure that strap 16 may be adjustably or non-adjustably coupled to clips, rings, or other mounts that are themselves coupled to the pack. In FIG. 6, examples of these configurations are graphically illustrated, with the right side of FIG. 6 showing a strap 16 that is coupled to a perimeter region 84 of the pack, and the left side of FIG. 6 showing a strap that is coupled to a projecting segment 88 and linkage 86 extends from the pack. Therefore, the continuous strap 16 presented herein may be described as being coupled to the pack proximate the pack, with "proximate" including straps that are fixedly coupled directly to the pack, straps that are releasably, non-adjustably and/or adjustably coupled to the pack by a fastening mechanism, and/or straps that are coupled to the pack by a short segment that extends from the pack.

When strap 16 extends only from the perimeter region of the pack or is otherwise not adapted to draw the outer surface of the pack toward the body-contacting surface of the pack to apply compression to a reservoir within the pack, the strap may be described as not providing a reservoir compression assembly. Such a waist-mounted hydration system is within the scope of the present disclosure, as is a waist-mounted hydration system that includes the above-described compression assembly implemented with a strap assembly that includes at least two discrete strap segments that are coupled together with a releasable fastening mechanism proximate the user's abdomen. However, in many applications it may be desirable to include the continuous strap and compression assembly described herein.

Figure 7:
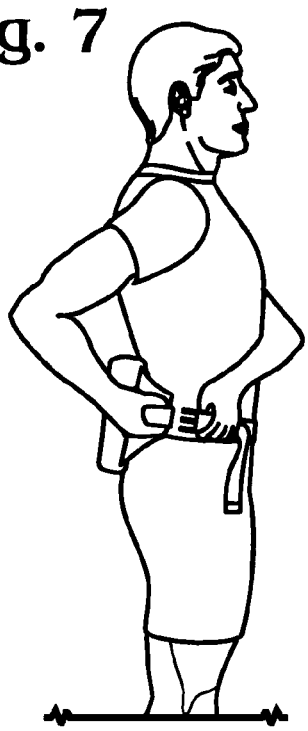
FIG. 7 is an elevation view of a user coupling a waist-mounted hydration system according to the present disclosure around the user's waist.
Figure 8:
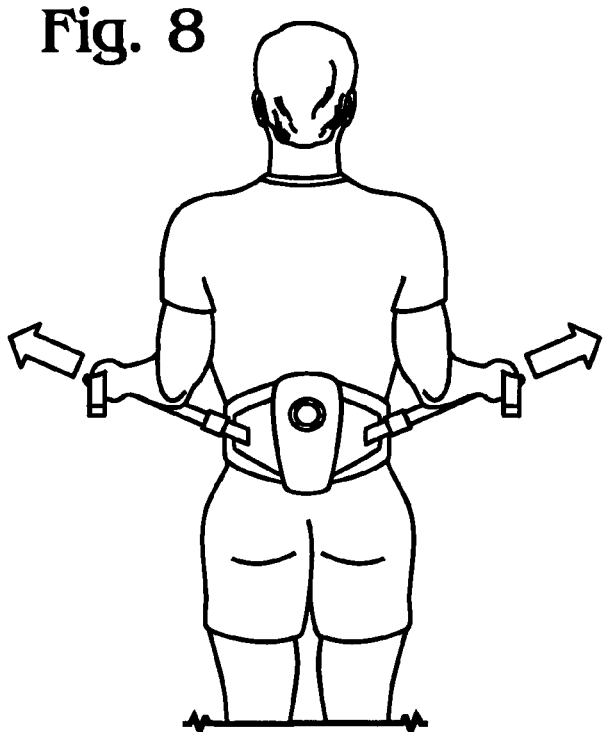
FIG. 8 is an elevation view of the user adjusting the compression and waist dimension of the hydration system of FIG. 7.
Figure 9:
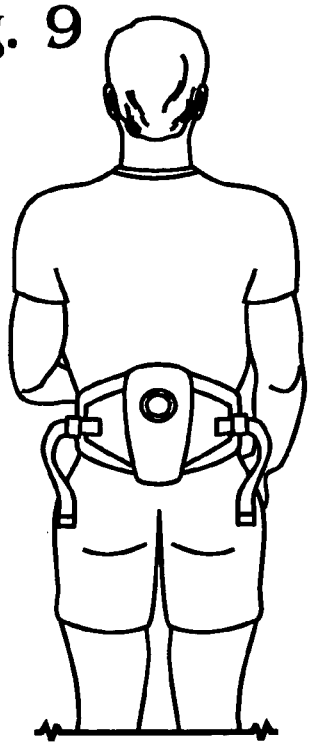
FIG. 9 is an elevation view of the user engaged in an athletic activity while wearing the hydration system of FIG. 7.

FIGS. 7–9 graphically provide an illustrative (and non-exclusive) method of using a waist-mounted hydration system of FIGS. 1 and 2. As shown in FIG. 7, the hydration system includes at least one releasable fastening mechanism. The members forming the releasable fastening mechanism are secured together such that the pack and strap form a closed loop around the user's waist. The pack may be positioned relative to the user's back prior to securing the fastening mechanism's members together. Alternatively, the hydration system may be rotated relative to the user's waist after securing the members together to position the pack. If the user had previously worn (and adjusted) the hydration system, the hydration system may be sufficiently compressed to need no further adjustment. However, if the user wants to adjust the compression applied to the reservoir and/or the size of the closed loop, the user can selectively draw upon either of the free end regions of the strap, as shown in FIG. 8. As graphically illustrated in FIG. 8, the user may increase the compression by pulling the free end region generally forward relative to the user's body. As discussed, selecting which end region to draw upon may provide for adjustment of the positioning of the pack relative to the user's back. As also discussed, it is within the scope of the disclosure that the strap may not include a pair of adjustable free end regions, in which case the user's options regarding selectively applying compression to the pack would be more limited. After securing the pack around the user's waist and adjusting the compression applied thereto, the user then engages in athletic activities, such as running, jogging, walking, hiking, etc., as graphically illustrated in FIG. 9. As the user draws fluid from the reservoir through the drink tube, the user may want to increase the compression applied to the reservoir by again pulling upon either of the free end regions of the strap, which in the illustrated embodiment, conveniently hang from behind the user. If at any point the user wants to increase the size of the closed loop or reduce the compression applied to the reservoir, the user can manipulate the fastening mechanism that provides for adjustment of the strap to provide the desired reduction in compression and/or increase in size.

As discussed, waist-mounted hydration systems 10 according to the present disclosure include a hydration assembly 14 that stores a volume of drink fluid and selectively dispenses the drink fluid to the user. Illustrative examples of hydration assemblies are shown in FIGS. 10–13, with the reservoirs of the illustrative examples shown in FIGS. 10–13 preferably being resized to conform to the shape of the compartment of a particular pack 12. Hydration assembly 14 includes at least a fluid reservoir 100 that is adapted to hold a volume of potable drink fluid, such as water or a sports drink. The reservoir includes an exit port 102 through which drink fluid is selectively dispensed from the reservoir into an end region 104 of an elongate drink tube 106. A user draws drink fluid from the distal end region 108 of the drink tube, such as by sucking upon a mouthpiece 110.

Reservoir 100 may be formed from any suitable rigid and/or flexible material. Preferably, the reservoir is at least substantially, if not completely, formed from a flexible material that is itself either waterproof or which includes a waterproof liner or other layer. An example of a suitable material is polyurethane, although others may be used. Reservoir 100 is preferably sized to hold at least 20 fluid ounces of drink fluid. Because hydration system 10 is designed to be supported around a user's waist by waist strap 16 and without requiring shoulder straps, the reservoir will typically be sized to not hold more than 100 oz. of drink fluid. Therefore, reservoir 100 may be sized to hold 20–100 oz. of drink fluid, with illustrative (full-reservoir) volumes being 28–32 oz., 45–55 oz., and 60–70 oz. Illustrative examples of reservoir volumes include 32 oz., 48 oz., 64 oz., and 80 oz. If one or more shoulder straps are added to the hydration system, the capacity of the reservoir may be increased.

As shown in FIGS. 10–13, the drink tube terminates at a mouthpiece 110, which is removably coupled to the end of the drink tube distal, or downstream from, the reservoir. In the illustrated examples, mouthpiece 110 takes the form of a bite-actuated mouthpiece that is selectively configurable between a dispensing position, in which drink fluid may be drawn from the reservoir and through an outlet or opening in the mouthpiece, and a closed position, in which the opening is closed so that drink fluid cannot pass therethrough. In FIGS. 14 and 15, an illustrative bite-actuated mouthpiece is shown in its closed and dispensing positions. A bite-actuated mouthpiece is a resilient, self-sealing mouthpiece that is biased to the closed position, and is adapted to be configured to the dispensing position by a user placing the mouthpiece in the user's mouth and biting upon the appropriate sidewalls of the mouthpiece. Illustrative examples of bite-actuated mouthpieces are disclosed in U.S. Pat. Nos. 6,070,767, 6,032,831, and 6,364,168, the complete disclosures of which are hereby incorporated by reference for all purposes. It is within the scope of the disclosure that the waist-mounted hydration systems disclosed herein may be used with other bite-actuated mouthpieces, that the hydration systems may be used with mouthpieces that are not self-sealing mouthpieces and which therefore require manual manipulation between the dispensing and closed positions, and that the hydration systems may be used with mouthpieces that are integrated with the drink tube.

Figure 10:
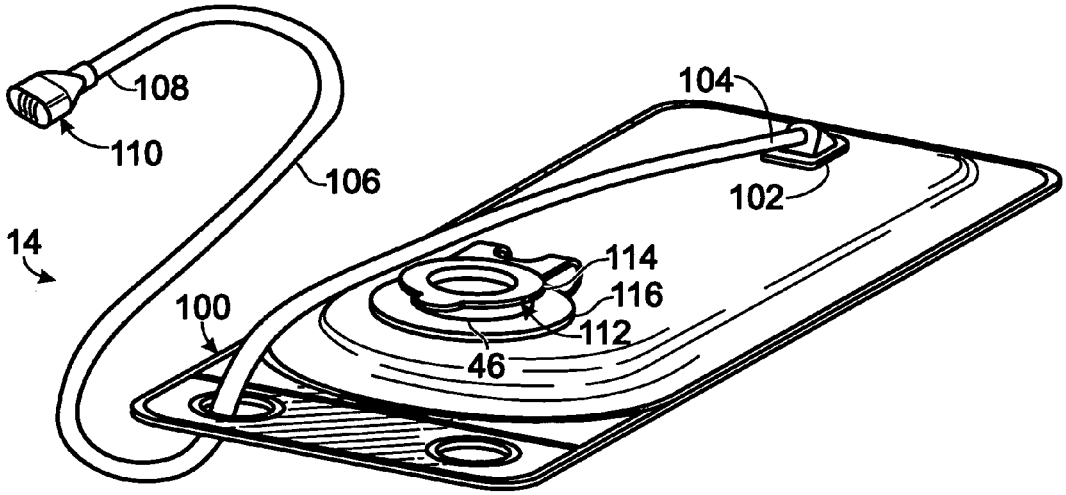
FIG. 10 is an isometric view of an illustrative hydration assembly.

Reservoir 100 is preferably adapted to be selectively refilled, such as through a sealable fill port 46, and is in fluid communication with drink tube 106. The fill port may be selectively sealed by any suitable closure mechanism 112. In the illustrated examples, the reservoirs are shown including closure mechanisms 112 in the form of caps 114 that are removably coupled to the fill port to selectively seal the fill ports, although any suitable mechanism for selectively sealing the fill ports of the reservoirs may be used without departing from the scope of the present disclosure. In FIG. 10, the cap is adapted to seal the fill port through a simple friction fit, namely by pushing the cap into the fill port, while in FIGS. 11 and 12 the caps are adapted to threadingly engage a corresponding set of threads on the fill ports. Any suitable closure mechanism and sealing mechanism(s) may be used.

Figure 13:
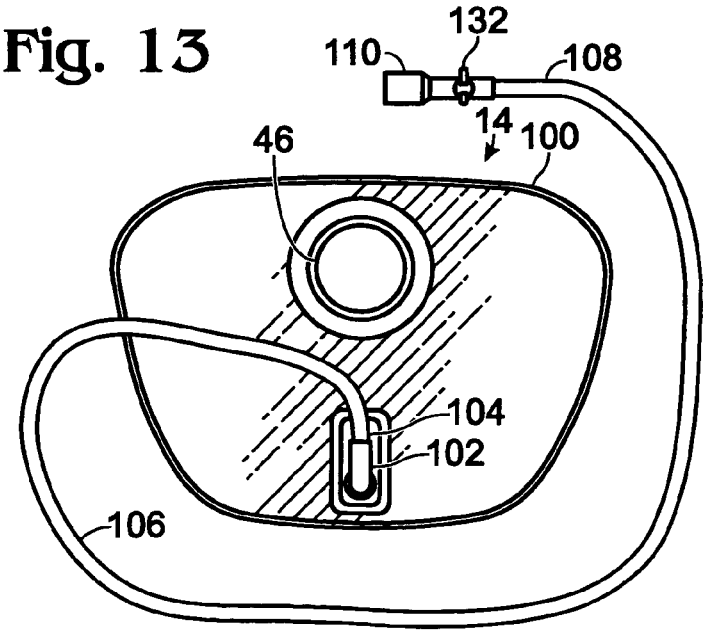
FIG. 13 is a top plan showing another illustrative hydration assembly.
Figure 11:
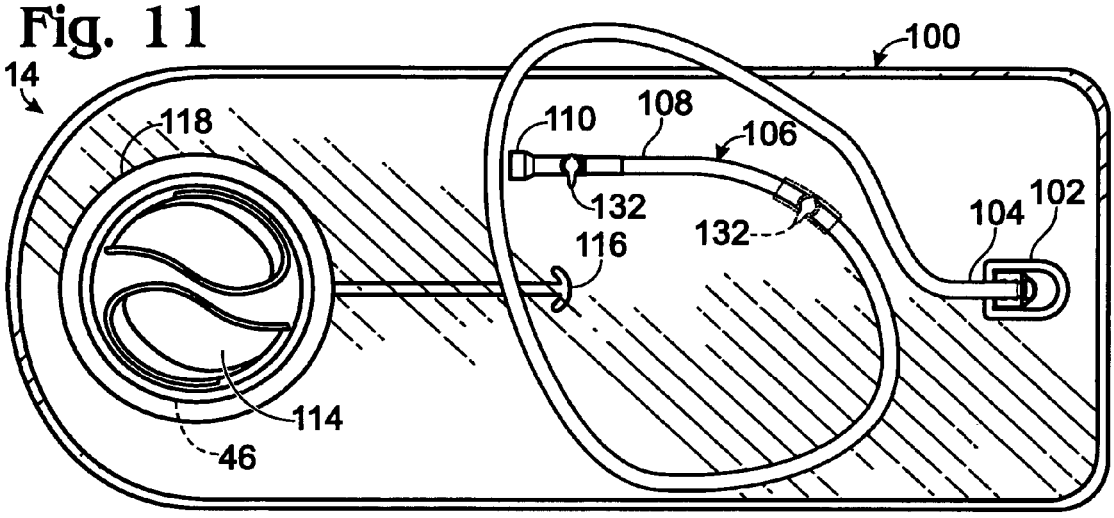
FIG. 11 is a top plan view of another illustrative hydration assembly.
Figure 12:
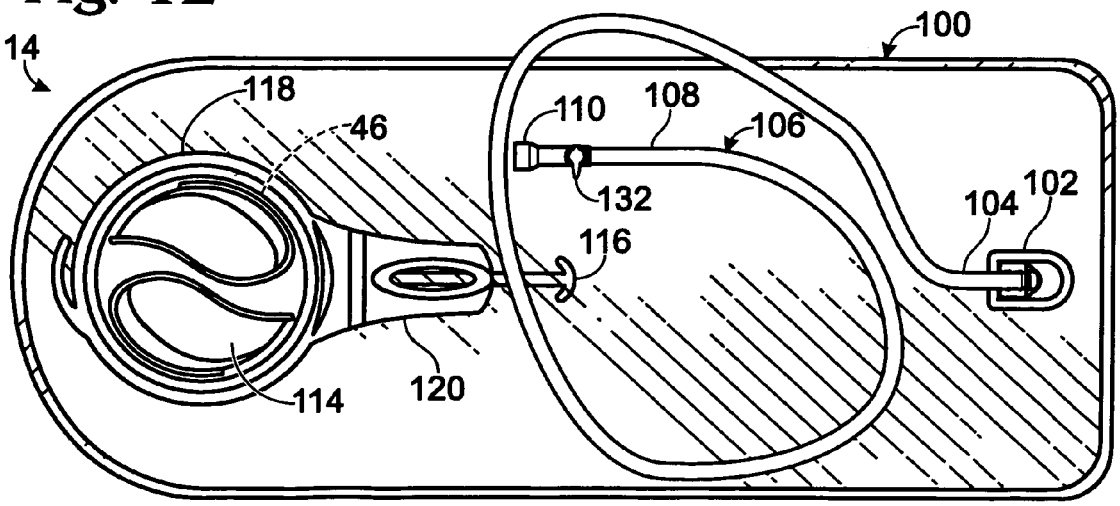
FIG. 12 is a top plan view of another illustrative hydration assembly.

In FIG. 10, the cap is coupled to the fill port by an optional tether 116 that extends from the cap and around the fill port. Tether 116 does not provide support to the fill port but does retain the cap proximate the fill port. In FIG. 11, fill port 46 is shown being sealed by a removable cap 114, with the fill port being supported by a collar 118 that extends around the fill port and provides support thereto. Also shown in FIG. 11 is another example of a suitable tether 116, with the illustrated tether extending within the reservoir when the fill port is sealed by the cap. In FIG. 12, the fill port includes a support collar with a projecting handle 120. Handle 120 may be used to position the reservoir for filling, and also may function as a counter-lever as the user twists or otherwise manipulates the cap to remove or secure the cap relative to the fill port. Preferably, the handle of the collar extends in a fixed orientation or limited range of rotational orientations relative to the fill port. FIG. 13 demonstrates a reservoir that has a wider, shorter relative size compared to the illustrated reservoirs of FIGS. 10–12, with the illustrated reservoir perhaps being more appropriately sized for inclusion in a waist-mounted hydration system that has a lower, and optionally wider, profile than many backpack hydration systems. Additional examples of suitable structures for the hydration assemblies are disclosed in pending U.S. Pat. No. 6,675,998, the complete disclosure of which is hereby incorporated by reference for all purposes.

Figure 19:
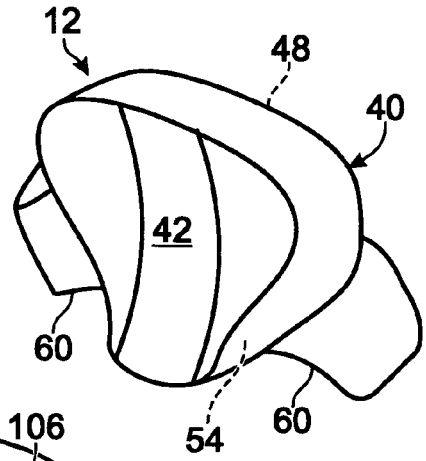
FIG. 19 is a perspective view of a body-contacting surface of another illustrative pack for a waist-mounted hydration system according to the present disclosure.
Figure 18:
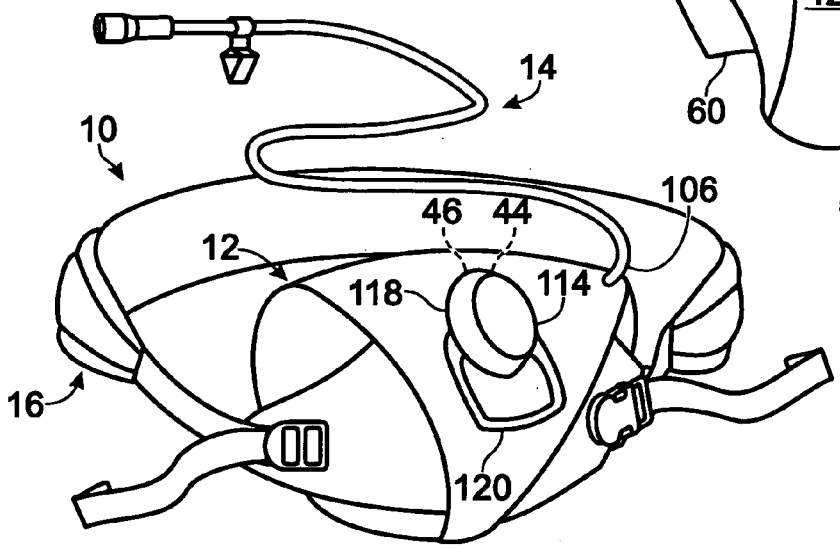
FIG. 18 is a rear perspective view of another waist-mounted hydration system according to the present disclosure.
Figure 20:
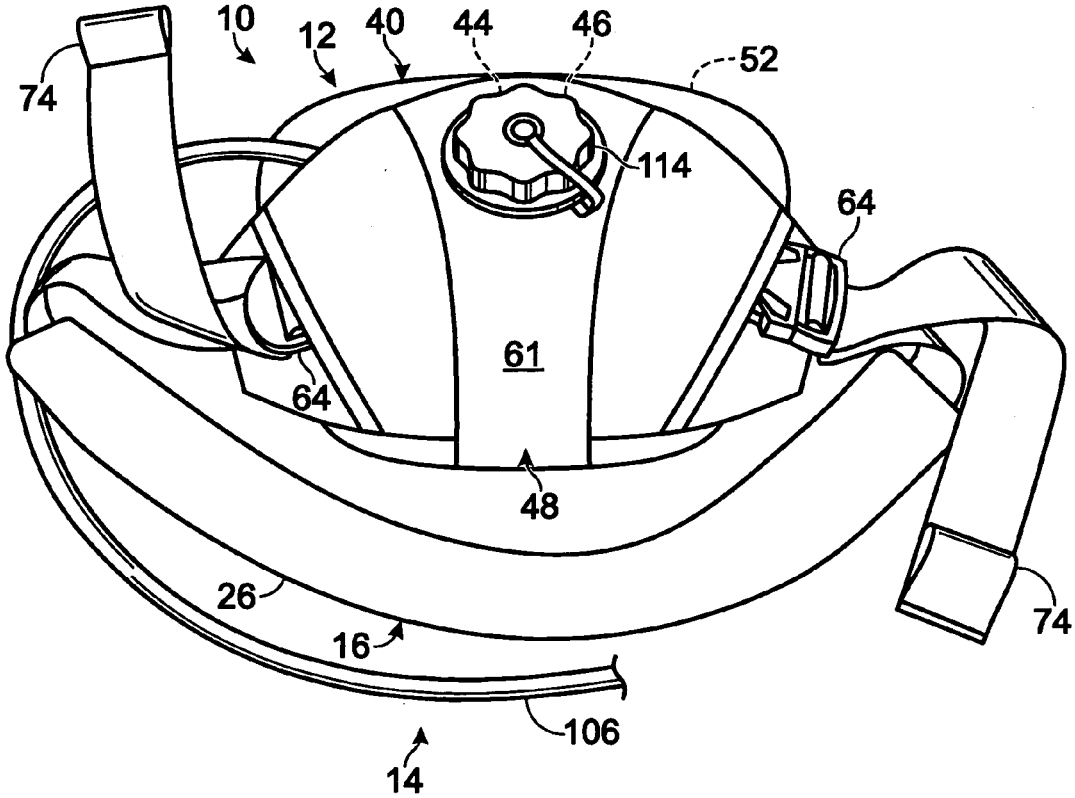
FIG. 20 is a rear view of another waist-mounted hydration system according to the present disclosure.
Figure 21:
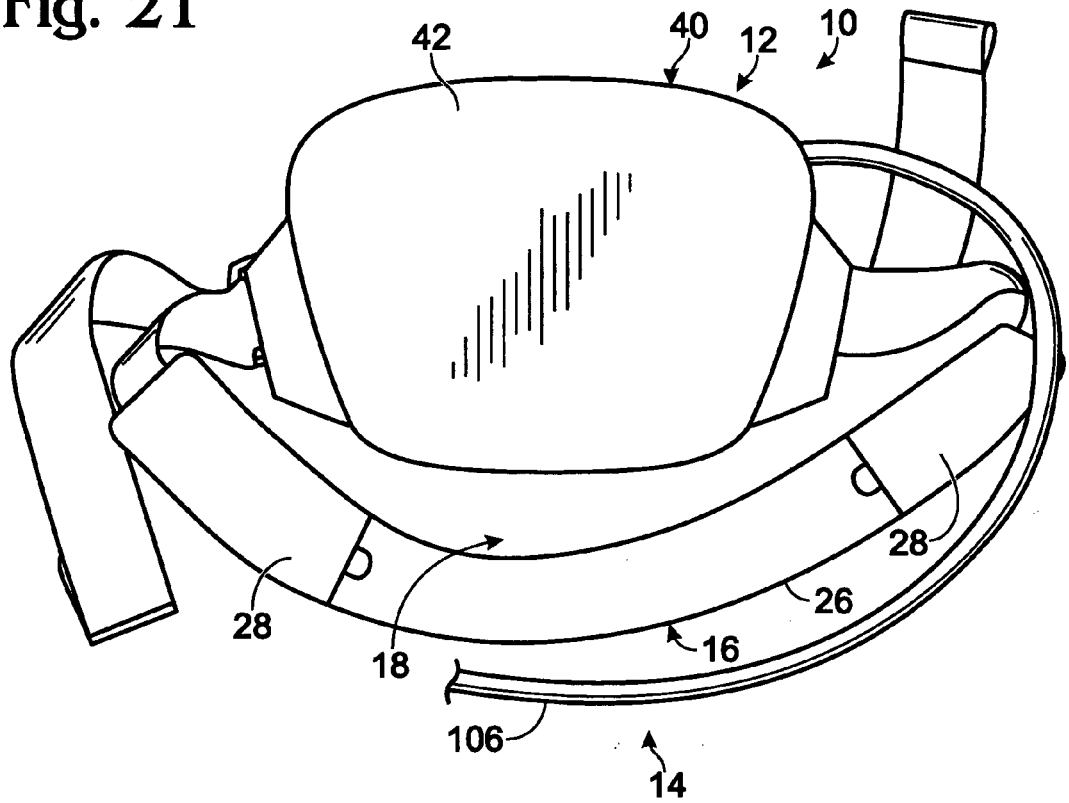
FIG. 21 is a front view of the hydration system of FIG. 20.
Figure 22:
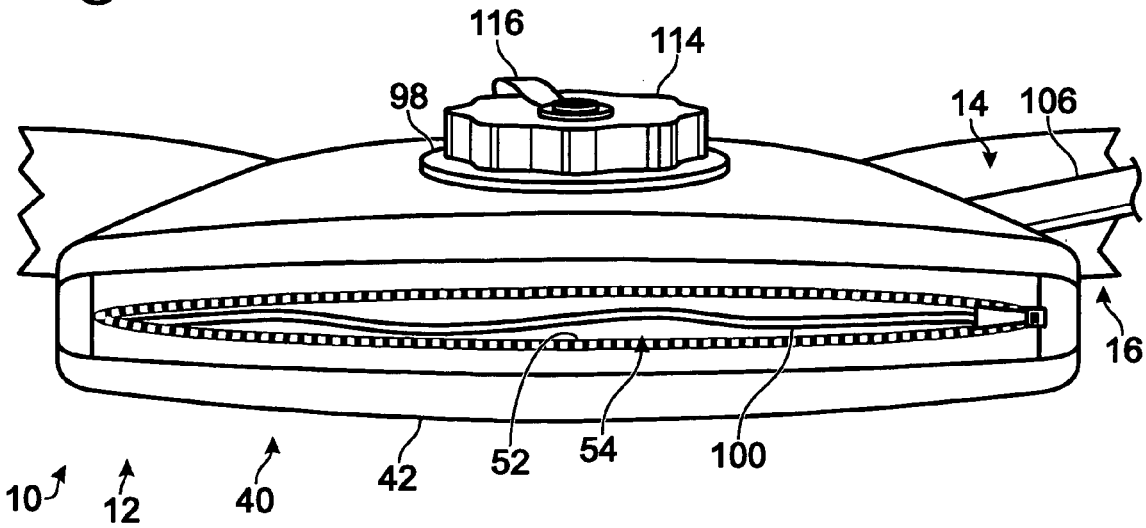
FIG. 22 is a top view of the hydration system of FIG. 20.

FIG. 16 provides an example of a hydration system 10 with a resized reservoir with a collar and handle assembly similar to that shown in FIG. 12. FIGS. 17 and 18 provide additional examples of hydration systems 10 with a pack having a fill port opening 44 through which a fill port 46 of hydration assembly 14 extends, with the hydration assembly including a support collar with another example of a suitable projecting handle 120. FIG. 19 provides another illustrative example of a suitable pack configuration, with the pack having a tapered configuration FIGS. 20–22 show another example of a waist-mounted hydration system 10 according to the present disclosure, with the pack of FIGS. 20–22 being sized to receive the reservoir of FIG. 13. As shown, the pack includes a pair of flaps, or compression wings, to which strap 16 is adjustably coupled. In this illustrative example, strap 16 includes a pair of compartments 28 that are selectively closed via hook-and-loop closure mechanisms, as perhaps best seen in FIG. 21. As perhaps best seen in FIG. 20, the pack includes a fill port opening 44 through which at least a portion of the fill port 46 of the reservoir extends, with the fill port being selectively sealed by a threaded cap 114 that is coupled to the fill port by a tether 116. As perhaps best seen in FIG. 22, the pack includes a reservoir opening 52 through which the reservoir may be selectively inserted into and removed from the pack's compartment 54.

In at least FIGS. 11–13, hydration assembly 14 is shown including an optional accessory in the form of a manually actuated on/off valve 132. In at least FIG. 1, hydration assembly 14 is shown including an optional accessory in the form of a clip 134 that is adapted to be removably coupled to a user's clothing, such as to a user's shirt to retain the mouthpiece and corresponding portions of the drink tube in a position for easy positioning into a user's mouth. Illustrative examples of other optional accessories that may be used with hydration systems according to the present disclosure are disclosed in U.S. patent application Ser. Nos. 10/617,879 and 10/666,856, the complete disclosures of which are hereby incorporated by reference for all purposes.

Many of the drawing figures that correspond to the above description illustrate two or more features or structural components of waist-mounted hydration systems according to the present disclosure. It is within the scope of the disclosure that the individual features or structural components may be separately implemented and/or implemented in combination with other features or structural components, including (but not limited to) those that are disclosed, illustrated and/or incorporated herein.

INDUSTRIAL APPLICABILITY

The present disclosure is applicable to the hydration fields, and are specifically applicable to waist-mounted personal hydration systems.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A waist-mounted hydration system, comprising:

a hydration assembly, comprising:

a fluid reservoir adapted to receive a volume of potable drink fluid and having an exit port;

an elongate drink tube in fluid communication with the fluid reservoir and adapted to receive drink fluid therefrom;

a mouthpiece in fluid communication with the drink tube and adapted to dispense drink fluid therefrom;

a pack, comprising:

a pack body having a width and defining a compartment containing the reservoir, wherein the pack body includes an interior surface adapted to face a user's body and an exterior surface generally opposed to the interior surface, wherein the area between the interior surface and exterior surface defines a thickness of the pack body, and wherein the exterior surface includes a central region bounded laterally by perimeter regions, wherein the central region is less than and located within the width of the pack body; and a reservoir compression assembly, comprising:

a pair of generally opposed flaps extending from the central region of the pack body and extending across at least a portion of the perimeter region of the exterior surface of the pack body; wherein the flaps overlap with, but are not directly secured to, the perimeter regions of the exterior surface of the pack body; and an adjustable waist-strap assembly coupled to the pair of generally opposed flaps and adapted to selectively define a closed perimeter with the pack around a user's waist, wherein the waist-strap assembly includes a body-facing surface adapted to form a portion of the closed perimeter, wherein the waist-strap assembly includes a free end region that does not form a portion of the closed perimeter, and further wherein responsive to a force applied to the free end region and adapted to draw the free end region away from the pack body, the compression assembly is adapted to initially apply compression to the reservoir and thereafter decrease the length of the body-facing surface of the waist-strap assembly.

2. The waist-mounted hydration system of claim 1, wherein the central region extends over at least 75% of the reservoir.

3. The waist-mounted hydration system of claim 1, wherein the entire body-facing surface is soft and pliable.

4. The waist-mounted hydration system of claim 1, wherein the body-facing surface is free from buckles.

5. The waist-mounted hydration system of claim 1, wherein the body-facing surface is free from rigid components.

6. The waist-mounted hydration system of claim 1, wherein the free end region extends from proximate the pack body.

7. The waist-mounted hydration system of claim 1, wherein the hydration system includes at least one adjustable fastening mechanism interconnecting the waist strap assembly and the pack.

8. The waist-mounted hydration system of claim 1, wherein the hydration system includes at least one releasable fastening mechanism interconnecting the waist strap assembly and the pack.

9. The waist-mounted hydration system of claim 1, wherein the reservoir includes a sealable fill port and the exterior surface of the pack includes a fill port opening through which at least a portion of the fill port extends.

10. The waist-mounted hydration system of claim 1, wherein the mouthpiece is a self-sealing mouthpiece adapted to selectively dispense drink fluid from the drink tube to a user, wherein the mouthpiece is selectively configured between a closed position, in which the mouthpiece is adapted to prevent drink fluid from being dispensed therethrough, and a dispensing position, in which the mouthpiece is adapted to permit drink fluid to be dispensed therethrough, wherein the mouthpiece is adapted to be configured from the closed position to the dispensing position responsive to compressive forces applied thereto, and further wherein the mouthpiece is biased to automatically return from the dispensing position to the closed position.

11. The waist-mounted hydration system of claim 1, wherein responsive to the force applied to the free end region of the waist-strap assembly, the compression assembly is adapted to draw the exterior surface of the pack body toward the interior surface of the pack body to apply compression to the reservoir within the pack body.

12. The waist-mounted hydration system of claim 1, wherein responsive to the force applied to the free end region of the waist-strap assembly, the compression assembly is adapted to draw the exterior surface of the pack body toward the interior surface of the pack body to apply compression to the reservoir within the pack body prior to decreasing the length of the body-facing surface of the strap assembly.

13. The waist-mounted hydration system of claim 1, wherein the body-facing surface is a continuous surface that includes an abdomen-facing region adapted to face a user's abdomen when the system is worn around a user's waist and a pair of spaced-apart hip-facing regions that are adapted to face a user's hips when the system is worn around a user's waist.

14. The waist-mounted hydration system of claim 13, wherein the abdomen-facing region and the hip-facing regions are contiguous.

15. The waist-mounted hydration system of claim 1, wherein the flaps define elongate attachment regions with the pack body.

16. The waist-mounted hydration system of claim 15, wherein the elongate attachment regions have lengths of at least twice the height of the waist strap assembly.

17. The waist-mounted hydration system of claim 15, wherein the elongate attachment regions have lengths of at least ⅔ of the height of the pack body.

18. The waist-mounted hydration system of claim 15, wherein the flaps are tapered from the attachment end regions toward the waist-strap assembly.

19. A waist-mounted hydration system, comprising:

a hydration assembly, comprising:

a fluid reservoir adapted to receive a volume of potable drink fluid and having an exit port;

an elongate drink tube in fluid communication with the fluid reservoir and adapted to receive drink fluid therefrom;

a mouthpiece in fluid communication with the drink tube and adapted to dispense drink fluid therefrom;

a pack, comprising:

a pack body having a width and defining a compartment containing the reservoir, wherein the pack body includes an interior surface adapted to face a user's body and an exterior surface generally opposed to the interior surface, wherein the area between the interior surface and defines a thickness of the pack body, and wherein the exterior surface includes a central region bounded laterally by perimeter regions, wherein the central region is less than and located within the width of the pack body; and an adjustable waist-strap assembly coupled to the pack and adapted to define a closed perimeter with the pack around a user's waist, wherein the waist-strap assembly includes a body-facing surface adapted to form a portion of the closed perimeter and at least one free end region, wherein the waist-strap assembly is coupled to the pack body by a pair of fastening mechanisms, and further wherein the body-facing surface defines a continuous length that is free of fastening and adjustment mechanisms and which includes an abdomen-facing region adapted to face a user's abdomen when the system is worn around a user's waist and a pair of spaced-apart hip-facing regions that are adapted to face a user's hips when the system is worn around a user's waist, wherein the waist-strap assembly includes at least one free end region that does not form a portion of the closed perimeter and which is adapted to selectively tighten the closed perimeter upon lengthening of the free end region, wherein the hydration system includes a pair of generally opposed flaps that extend from the central portion of the exterior surface of the pack body and to which the waist-strap assembly is connected, wherein the flaps overlap with, but are not directly secured to, the perimeter regions of the exterior surface of the pack body, and further wherein the flaps are configured to initially apply compression to the reservoir upon receipt of user-applied forces to lengthen the free end region.

20. The waist-mounted hydration system of claim 19, wherein the entire body-facing surface is soft and pliable.

21. The waist-mounted hydration system of claim 19, wherein the body-facing surface is free from buckles.

22. The waist-mounted hydration system of claim 19, wherein the body-facing surface is free from rigid components.

23. The waist-mounted hydration system of claim 19, wherein the abdomen-facing region and the hip-facing regions are contiguous.

24. The waist-mounted hydration system of claim 19, wherein the fastening mechanisms couple the waist strap assembly to the pack body proximate the pack body.

25. The waist-mounted hydration system of claim 19, wherein the at least one free end region extends from proximate the pack body.

26. The waist-mounted hydration system of claim 19, wherein the flaps are configured to initially draw the exterior surface of the pack body toward the interior surface of the pack body to apply compression to the reservoir upon receipt of user-applied forces to lengthen the free end region.

* * * * *

UNITED STATES PATENT AND TRADEMARK OFFICE

CERTIFICATE OF CORRECTION

PATENT NO. : 7,201,299 B2
APPLICATION NO. : 10/917207
DATED : April 10, 2007
INVENTOR(S) : Barley A. Forsman It is certified that error appears in the above-identified patent and that said Letters Patent is hereby corrected as shown below:

Column 13,
Line 22, after "interior surface and" please insert --the exterior surface-- therefor.

Signed and Sealed this

Seventh Day of August, 2007

JON W. DUDAS
*Director of the United States Patent and Trademark Office*